US005813926A

United States Patent [19]

Vance

[11] Patent Number: 5,813,926

[45] Date of Patent: Sep. 29, 1998

[54] METHOD AND MEANS FOR PRACTICING FREE THROWS

[76] Inventor: William A. Vance, 122 S. Main, Box 282, Hazleton, Iowa 50641

[21] Appl. No.: 883,864

[22] Filed: Jun. 27, 1997

[51] Int. Cl.[6] ..... A63B 69/00

[52] U.S. Cl. ..... 473/448; 473/433

[58] Field of Search ..... 473/447, 448, 473/433, 477, 100, 101

[56] References Cited

U.S. PATENT DOCUMENTS

| | | | |
|---|---|---|---|
| 2,074,125 | 3/1937 | Lefft | 473/477 |
| 2,884,252 | 4/1959 | Thompson | 473/477 |
| 4,565,527 | 1/1986 | Burchett | 434/428 |
| 4,838,549 | 6/1989 | Woodall | 473/433 |
| 5,035,423 | 7/1991 | Archiniega | 473/433 |
| 5,183,253 | 2/1993 | Grimaldi et al. | 473/433 |
| 5,273,275 | 12/1993 | Wilkerson | 473/433 |
| 5,364,091 | 11/1994 | Sebek | 473/433 |
| 5,374,054 | 12/1994 | Suess | 473/433 |
| 5,393,049 | 2/1995 | Nelson | 473/433 |
| 5,540,428 | 7/1996 | Joseph | 473/433 |
| 5,599,016 | 2/1997 | Larkin . | |

*Primary Examiner*—William H. Grieb

*Attorney, Agent, or Firm*—Zarley, McKee, Thomte, Voorhees & Sease

[57] ABSTRACT

A basketball free throw training apparatus has a frame having a top horizontal bar. The horizontal bar is adjustably mounted for vertical positioning on the frame, so that the bar can be raised in a horizontal position with respect to the frame and with respect to the floor upon which the frame is mounted. A pair of upstanding closely spaced guidebars extend upwardly from the bar and have a horizontal space therebetween sufficiently wide to permit a basketball to freely pass therebetween. The frame has an extended arm thereon which can be pivoted to a horizontal position and which can extend between the frame and the backboard of a basket so that the frame is accurately positioned from the basket based upon the stature and shooting technique of the user of the equipment. This arm is length adjustable so as to accommodate the spacing requirements of persons of different stature and skill. The method of using the foregoing equipment comprises positioning the frame in front of a basketball basket in spaced relation thereto; raising the bar to a height commensurate with the high point of the shooting trajectory of the person using the equipment, and spacing the bar horizontally from a basket a distance equal to the distance required for a basketball shot by a person to fall from the high point of the trajectory through the basket.

9 Claims, 3 Drawing Sheets

METHOD AND MEANS FOR PRACTICING FREE THROWS

BACKGROUND OF THE INVENTION

The technique of shooting free throws today focuses on the basketball player's stance, release and follow-through. While these factors are all important, an apparatus is needed to improve the confidence and accuracy of the shooter, with emphasis being made on each player establishing his or her shooting trajectory high point, whereupon the ball will float from the high point through the basket. Existing methods and apparatus do not include methodology or structure which include this emphasis.

It is therefore a principal object of this invention to provide a method and apparatus for practicing free throws which will teach the shooter to consistently shoot the ball to a uniform high point in a vertical plane between the shooter and the basket which will enable the ball to fall from and float through the basket.

These and other objects will be apparent to those skilled in the art.

BRIEF SUMMARY OF THE INVENTION

A basketball free throw training apparatus has a frame having a top horizontal bar. The horizontal bar is adjustably mounted for vertical positioning on the frame, so that the bar can be raised in a horizontal position with respect to the frame and with respect to the floor upon which the frame is mounted. A pair of upstanding closely spaced guidebars extend upwardly from the bar and have a horizontal space therebetween sufficiently wide to permit a basketball to freely pass therebetween. The frame has an extended arm thereon which can be pivoted to a horizontal position and which can extend between the frame and the backboard of a basket so that the frame is accurately positioned from the basket based upon the stature and shooting technique of the user of the equipment. This arm is length adjustable so as to accommodate the spacing requirements of persons of different stature and skill.

The method of using the foregoing equipment comprises positioning the frame in front of a basketball basket in spaced relation thereto; raising the bar to a height commensurate with the high point of the shooting trajectory of the person using the equipment, and spacing the bar horizontally from a basket a distance equal to the distance required for a basketball shot by a person to fall from the high point of the trajectory through the basket.

DESCRIPTION OF THE PREFERRED EMBODIMENT

Figure 1:
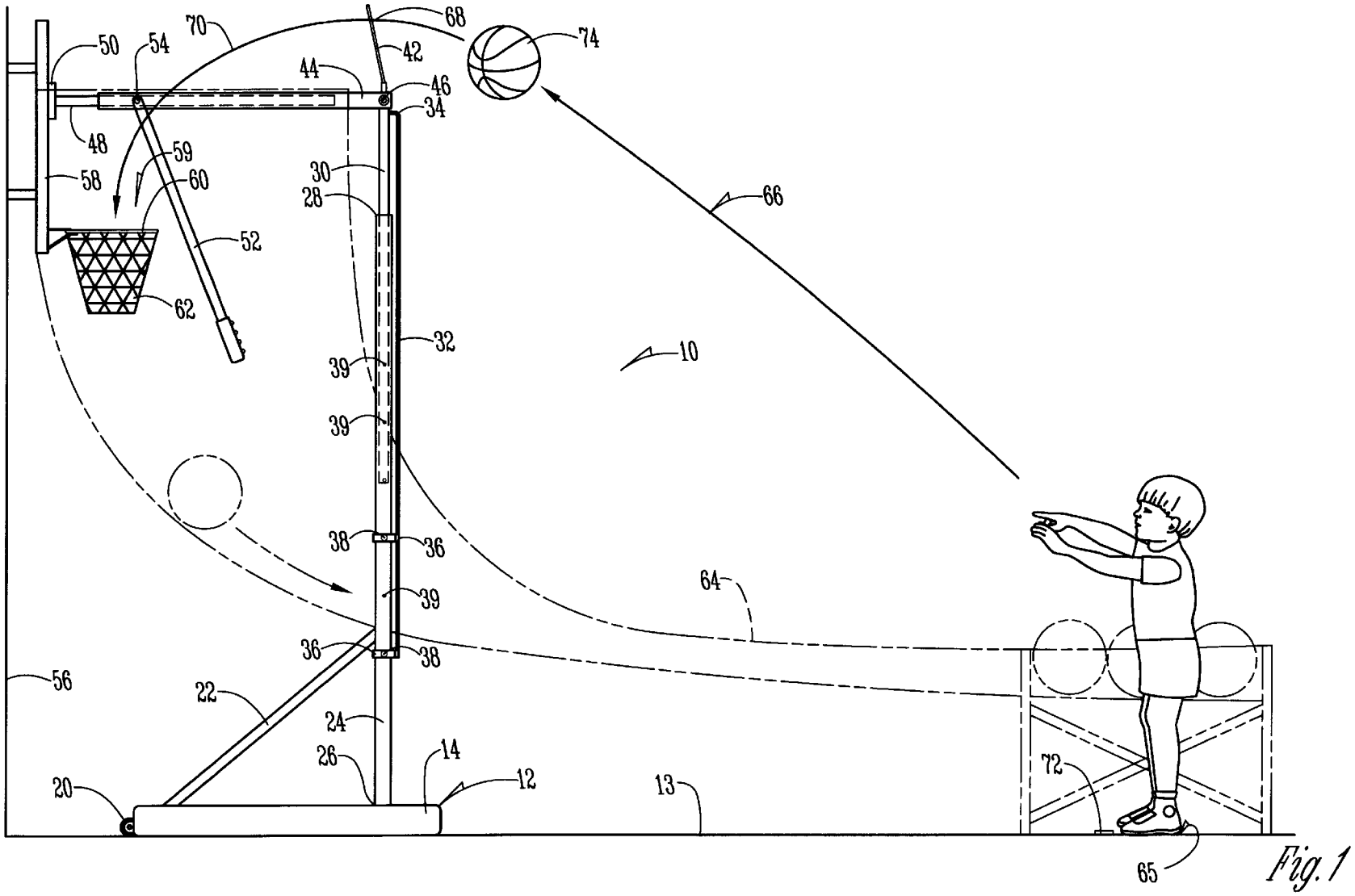
FIG. 1 is a side elevational view of the device of this invention when in use.
Figure 2:
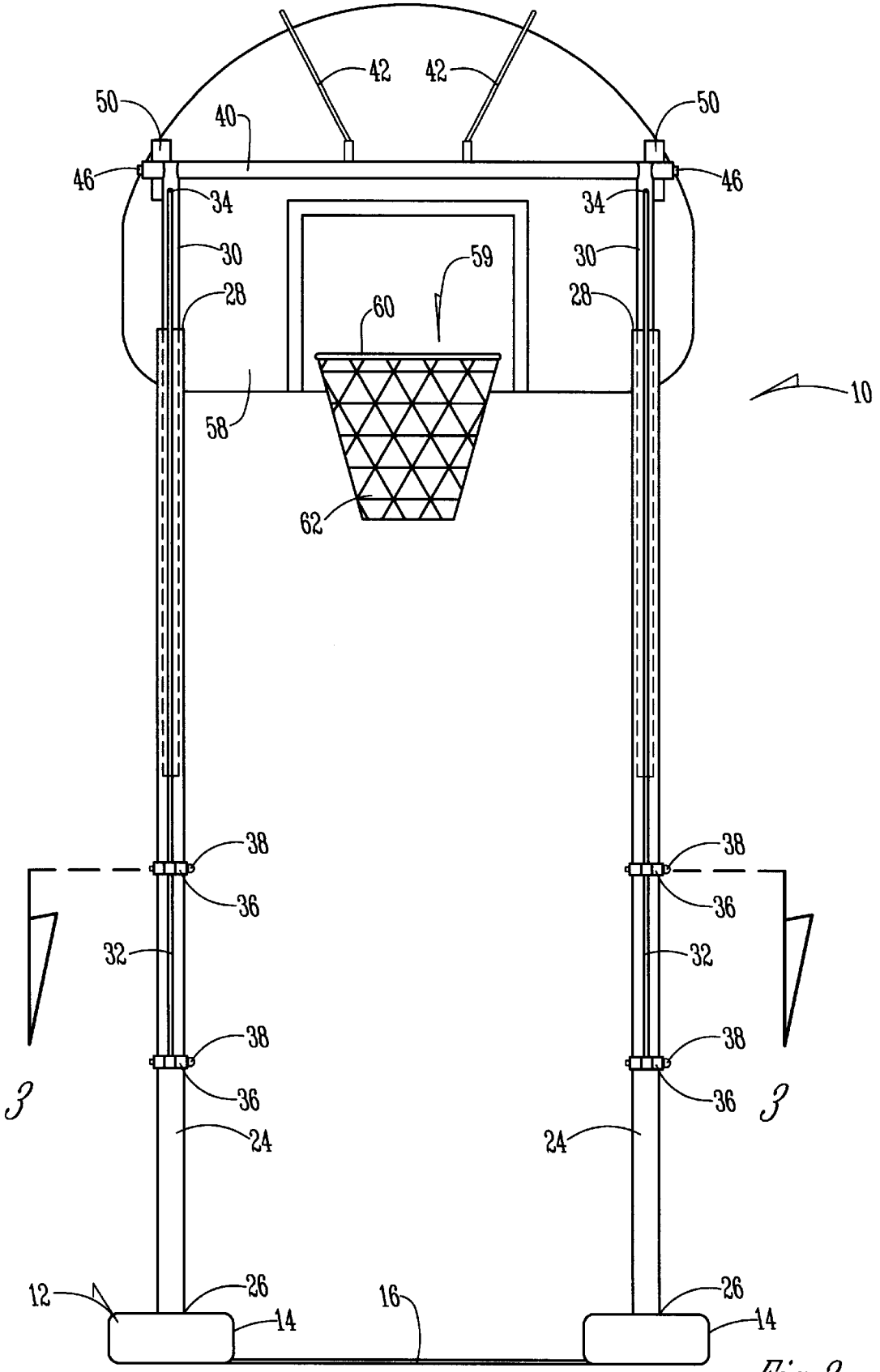
FIG. 2 is an enlarged scale front elevational view thereof.
Figure 3:
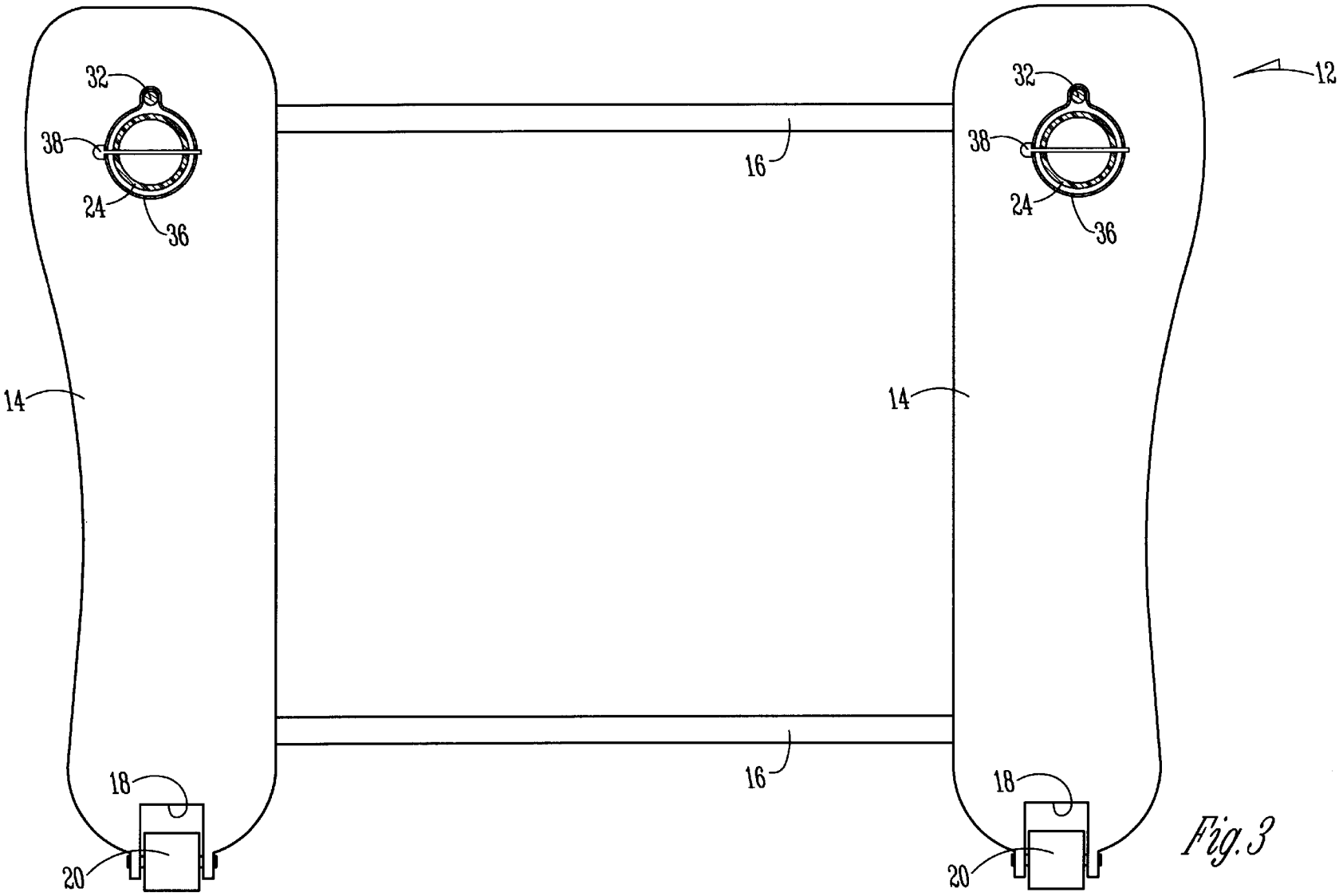
FIG. 3 is an enlarged scale sectional view taken on line 3—3 of FIG. 2.

The free-throw training apparatus 10 has a frame 12 which is mounted typically on a horizontal indoor or outdoor floor 13. Frame 12 includes a pair of spaced base members 14 filled with sand or the like to provide a stable foundation for frame 12. As seen in FIG. 3, a pair of cross members 16 are secured by their ends to base members 14 and maintain the base members in parallel relation. As also seen in FIG. 3, notches 18 are provided in one end of the base members 14 and wheels 20 are rotatably mounted therein to facilitate the movement of the frame from place to place on a floor surface such as floor 13. Diagonal braces 22 (FIG. 1) are secured by their ends to base members 14 and to a pair of outer hollow posts 24 which are mounted at their lower ends 26 to the ends of base members 14 opposite to wheels 20. Inner posts 30 are telescopically mounted in posts 24. Elongated adjustment rods 32 are secured by their upper ends 34 to the upper end of inner posts 30. Retaining rings 36 are secured to rod 32 and in turn are adapted to be detachably secured to the outer post 24 by means of pins 38 (FIG. 3) which extend into one of a plurality of vertically spaced apertures 39 (FIG. 2).

A cross bar 40 (FIG. 2) is horizontally disposed and is mounted on the upper ends of posts 30. A pair of spaced guides 42 are centrally located on bar 40 and extend upwardly from the bar and outwardly with respect to each other (FIG. 2). A measuring arm 44 is secured to each of the upper ends of inner posts 30 by hinges 46 (FIG. 1). Rods 48 are telescopically received in the outer ends of arms 44 and an engagement pad 50 is secured to the outer ends of each of the rods 48. The rods 48 can be adjustably mounted within the arms 44 and adjustably secured thereto by pins or the like (not shown). An arm 52 is pivotally secured by its upper end to each of the arms 44 by means of hinges 54 to facilitate the positioning of the measuring arms.

With reference to FIG. 1, a vertical wall 56 provides support for a basketball backboard 58 having a conventional basket 59 comprised of rim 60 and a conventional net 62.

A conventional ball return 64 (FIG. 1) can be utilized to capture a basketball that either rebounds from the backboard 58 or goes through rim 60 to return the ball to a shooting station 65.

With reference to FIG. 1, the trajectory 66 of a ball being shot passes over and through the spaced guides 42 and achieves an apex or high point 68 either within the spaced guides 42 or just above. The numeral 70 indicates the final portion of the trajectory 66 as a ball moves.

In operation, the frame 12 is placed between the shooting station 65 and the basket 59 a distance approximately 13'-9 "from the free throw line 72 to the center of basket 59. The posts 24 are normally positioned about 40%of the distance from the center of basket 59 to free throw line 72. Measuring arm 44 and rod 48 are adjusted to the desired length for a given shooter. If the frame 12 is out of position before the practice session begins, the shooter can move arm 44 to a horizontal position (FIG. 1) by grasping arm 52, whereupon the frame 12 is moved towards the backboard 58 until pad 50 engages the backboard. Arm 44 can then be pivoted to a vertical non-operative position. The backboard 58 and related structure can be a part of frame 12 if desired.

The height of cross bar 40 can be adjusted by removing pins 38 from one level of apertures 39, and then raising or lowering rods 32 to raise or lower bar 40, and hence guides 42 to the desired height for a given shooter. The imaginary apex 68 for the desired trajectory 66 will be located above and between guides 42. The point 68 will normally be 11–16 inches above the front of rim 60. The trajectory portion 70 is the floater area for ball 74.

The objective is for the free throw shooter to look at the rim and peripherally locate the high point spot. Using free throw shooting form and a relaxed body, the basketball is released using measured strength and velocity, towards the high point 68. After passing this high point the basketball will float the rest of the way to the basket 60 on trajectory 70.

This device will help a shooter establish his or her high point 68. After repetitive use of this system, the frame 12 is removed and the shooter practices the technique of finding the high point and using the lob method to perfect the free throw shot.

Thus, the purpose of this apparatus is to help young basketball players develop an accurate free throw shooting eye.

It is therefore seen that this invention will achieve its stated objectives.

What is claimed is:

1. A basketball free throw shooting training device, comprising, a frame having a top horizontal bar, support means for supporting said frame on a horizontal floor surface, said support means including means for raising and lowering said horizontal bar, a pair of upstanding closely spaced guide bars extending upwardly from said horizontal bar and having a horizontal space therebetween sufficiently wide to permit a basketball to freely pass therethrough, whereby said frame can be placed between an elevated horizontal basketball rim and a predetermined free throw line to permit a player to shoot a basketball from the location of such line over said horizontal bar and between said guide bars in an arched path so that the shot ball will reach the apex of its trajectory after passing over said crossbar towards said rim, an adjustable measuring arm secured to said frame to permit said frame to be positioned from a basketball backboard assembly a predetermined distance.

2. The device of claim 1 wherein said support means includes a pair of spaced upstanding vertical posts.

3. The device of claim 2 wherein said posts are height adjustable, and said crossbar is mounted on said posts, so that the height of said guide bars can be adjusted.

4. The device of claim 1 wherein said measuring arm is hingedly secured to said frame.

5. The device of claim 4 wherein a positioning arm is pivotably secured to said measuring arm.

6. A method of practicing free throws, comprising, providing a vertical frame between a free throw line and a round basketball basket, providing spaced upstanding guides on said frame sufficiently spaced to receive a basketball therebetween, adjusting the height of said frame and said guides, and adjusting the position of said frame with respect to said basket, so that a basketball shot from said free throw line to and through said basket will follow a trajectory which will have a high point substantially above said frame and between said guides and spacing the guides on said frame a distance substantially the same as the diameter of said basket and only slightly greater than the diameter of said basketball.

7. The method of claim 6 further comprising the step of spacing said guide bars upwardly and outwardly from said horizontal bar.

8. A basketball free throw shooting training device, comprising, a frame having a top horizontal bar, support means for supporting said frame, said support means including means for raising and lowering said horizontal bar, a pair of upstanding closely spaced guide bars extending upwardly from said horizontal bar and having a horizontal space therebetween sufficiently wide to permit a basketball to freely pass therethrough, whereby said frame can be placed between an elevated horizontal basketball rim and a predetermined free throw line to permit a player to shoot a basketball from the location of such line over said horizontal bar and between said guide bars in an arched path so that the shot ball will reach the apex of its trajectory after passing over said crossbar towards said rim; the spacing of said guide bars being substantially the same as the diameter of said rim and only slightly greater than the diameter of said basketball.

9. The device of claim 8 where said guide bars extend upwardly and outwardly from said horizontal bar.

* * * * *